US005850667A

United States Patent [19]

Orsini

[11] Patent Number: 5,850,667

[45] Date of Patent: Dec. 22, 1998

[54] EXTENSION HANDLE FOR PORTABLE VACUUM

[76] Inventor: Joseph A. Orsini, 6620 Coral Lake Dr., Margate, Fla. 33063

[21] Appl. No.: 785,586

[22] Filed: Jan. 17, 1997

Related U.S. Application Data

[60] Provisional application No. 60/010,194 Jan. 18, 1996.

[51] Int. Cl.[6] ..... A47L 5/24

[52] U.S. Cl. ..... 15/339; 15/344; 15/350; 15/410

[58] Field of Search ..... 15/344, 350, 410, 15/339

[56] References Cited

U.S. PATENT DOCUMENTS 2,842,788 7/1958 Rench et al. ..... 15/410 X
4,635,315 1/1987 Kozak ..... 15/344 X
4,766,638 8/1988 McDowell ..... 15/410 X
4,876,763 10/1989 Cho et al. ..... 15/410 X

*Primary Examiner*—Chris K. Moore
*Attorney, Agent, or Firm*—Robert M. Downey, P.A.

[57] ABSTRACT

An extension handle for a portable vacuum includes an elongate shaft having a proximal end zone, a central zone, and a distal end zone. An attachment bracket for attaching the elongate shaft to a handle portion of the portable vacuum includes first and second pivoting members. The distal end zone of the shaft attaches to the first pivoting member which includes a finger extending therefrom, with a tip of the finger positioned in operative proximity to an on/off switch of the vacuum. The second pivoting member attaches to the handle portion of the portable vacuum, wherein pivoting movement of the first member relative to the second member results in operation of the on/off power switch to respectively activate and deactivate the vacuum.

11 Claims, 3 Drawing Sheets

20
22
30
32
33
34
35
38
42
44
46
48
49
50
52
54
60
62
64
10
2

EXTENSION HANDLE FOR PORTABLE VACUUM

BACKGROUND OF THE INVENTION

This application follows from Provisional Application Ser. No. 60/010,194 filed Jan. 18, 1996.

1. Field of the Invention

The present invention relates to an extension handle for a hand-held instrument and, more specifically, to an extension handle for a portable, hand-held vacuum.

2. Description of the Related Art

There are numerous hand-held electronic tools known in the art for performing various tasks. In particular, portable hand-held vacuums powered by rechargeable batteries have become quite popular in recent years. These devices are especially useful to vacuum the floor and seats in cars, boats, and smaller confined areas in a house or an apartment. Examples of such devices include those marketed under the trademarks "DUSTBUSTER" by Black & Decker, "WET & DRY" by Hoover, and "DIRT DEVIL" by Royal.

It has been discovered that these portable, lightweight vacuums are extremely efficient for quickly vacuuming smaller carpet and rug areas in an apartment or house, as well as drapes, valances over vertical blinds, shelves, and countertops. However, because these devices are hand-held and do not extend far from the gripping handle, it is often difficult to reach most areas being vacuumed. For instance, to vacuum a floor surface, it is necessary to bend over or kneel down in order to place the intake of the vacuum against the floor surface. This can place a great strain on one's lower back, knees, and arms, especially when vacuuming an entire carpeted area in a room or walk-in closet. Further, reaching such areas as valances, drapes, and shelving can be difficult, if not impossible, for people having limited mobility.

Accordingly, there exists a need for an extension handle which can be easily attached and adapted for use on a portable, hand-held vacuum of the type described above.

OBJECTS AND ADVANTAGES OF THE PRESENT INVENTION

It is a primary object of the present invention to provide an extension handle which is structured for attachment to all existing portable, hand-held vacuum models to thereby enable a user to vacuum floor surfaces, shelves, and the like without having to bend or climb on chairs or ladders.

It is a further object of the present invention to provide an extension handle for hand-held, portable vacuums which is specifically structured to activate the vacuum when the intake of the vacuum is pressed against a surface.

It is yet another object of the present invention to provide an extension handle for a hand-held, portable vacuum which can be collapsed for storage when not in use.

It is still another object of the present invention to provide an elongate extension handle for a hand-held, portable vacuum which is telescopic and which can be extended for use and collapsed for storage.

It is yet another object of the present invention to provide an elongate extension handle for a hand-held, portable vacuum and including a first portion attachable to the handle of the portable vacuum and second, detachable elongate shaft which can be removed from the first portion for storage.

These and other objects and advantages of the present invention are more readily apparent with reference to the following detailed description and the accompanying drawings.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF PREFERRED EMBODIMENTS

Figures 1A, 1B, 2, 3:
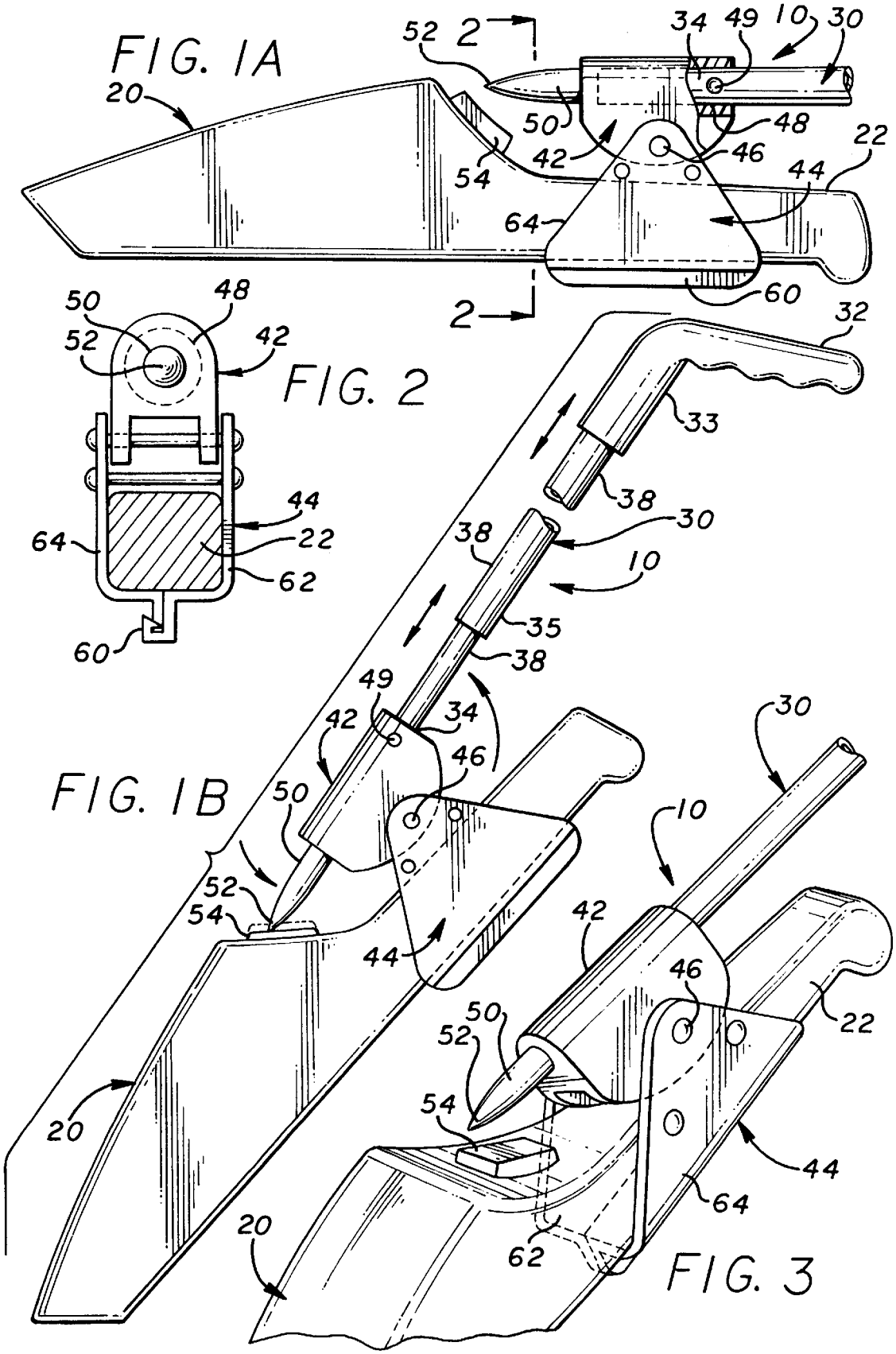
FIG. 1A is a side elevational view showing the extension handle assembly of the present invention attached to the handle portion of a portable vacuum, in accordance with a first embodiment of the invention.
FIG. 1B is a side elevational view illustrating the extension handle assembly of FIG. 1A shown in operative engagement with a switch of the vacuum, in an operating mode, wherein the vacuum is activated.
FIG. 2 is an end elevation, in partial section, taken along the plane indicated by line 2—2 of FIG. 1A.
FIG. 3 is an isolated perspective view of attachment means of the extension handle assembly of FIG. 1A, shown operatively attached to the handle portion of the vacuum.

Referring to the several views of the drawings, there is illustrated the extension handle assembly 10 of the present invention adapted for attachment to a handle portion 22 of a cordless, portable, hand-held vacuum 20.

Referring initially to FIG. 1, the extension handle assembly 10 includes an elongate shaft 30 having a handle 32 at a proximal end zone 33, a mid zone 35, and an oppositely disposed distal end zone 34. The assembly 10 further includes attachment means 40 for attaching the shaft 30 to the vacuum 20. The attachment means 40 is defined by a bracket structure 41 including a first pivoting member 42 and a second member 44 pivotally connected to the first member 42 at pivot point 46. The first pivoting member 42 is structured to receive the end zone 34 of the shaft 30 in snug-fitted, attached relation therewith. In a preferred embodiment, a socket 48 is provided on the first pivoting member for receipt of the distal end zone 34 therein. A spring biased locking button 49 or like means may be provided to releasably secure the distal end zone 34 in locked attachment within the socket. The second member 44 of the bracket structure 40 is specifically structured for removable attachment to the handle portion 22 of the portable vacuum 20 so that, when attached, the tip 52 of finger element 50 is positioned and disposed in operative proximity to an on/off power switch 54 on the vacuum 20. The second member 44 of the attachment bracket 40 includes a catch means 60 on one half 62 which grasps the opposite half 64 of the member 44, under the handle 22, so that the two halves 62, 64 can be secured together, once fitted about the handle 22 of the vacuum 20.

In a second preferred embodiment of the present invention, the assembly 10 is adapted for attachment to a portable vacuum 20' having a slide type on/off switch 54' and a closed loop handle 22'. In this particular embodiment, the first pivot member 42 can be provided with an attachment fitting such as, but not limited to, a reduced diameter stub 70 adapted for receipt within a hollow end of distal end zone 34 of the extension shaft 30. A spring biased button 72 or like element can be used to snap into locked engagement with a corresponding aperture or depression 73 within the hollow end of the shaft 30, to thereby lockingly engage the extension shaft 30 with the distal end zone 34, in much the same manner as the attachment structure on conventional vacuum hoses for attaching accessory tools thereto. Alternatively, the distal end zone 34 may be hollow and sized and configured for receipt of the end of the extension shaft therein. This arrangement allows the attachment means 40, including pivoting members 42, 44 to remain attached to the vacuum with the elongate shaft 30 removed for storage.

FIG. 1B illustrates attachment of the assembly 10 to a portable, hand-held vacuum 20 of the type having a straight handle portion 22. This embodiment further shows use of a telescoping shaft 30 including proximal end zone 33 having a handle 32, central telescoping zone 35 and distal end zone portion 34. The telescoping sections 38, are movable relative to one another in telescoping relation and are structured for locked engagement when fully extended.

Figure 4A:
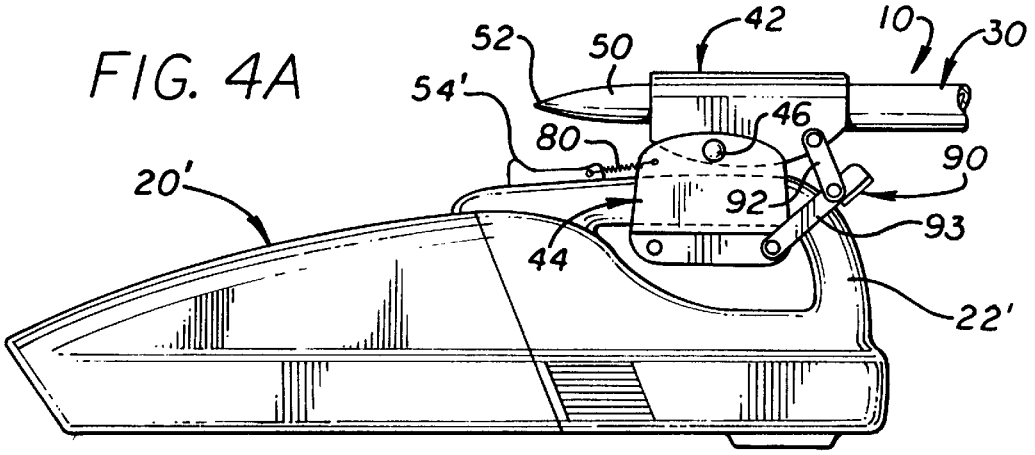
FIG. 4A is a side elevational view of the extension handle assembly shown attached to the handle portion of a portable vacuum, in accordance with a second embodiment of the present invention.
Figure 5:
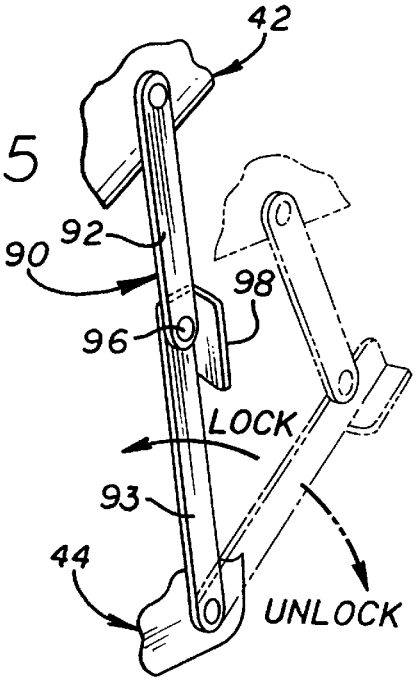
FIG. 5 is an isolated perspective view, illustrating operation of a locking means in accordance with the embodiment of FIG. 4A.
Figure 6:
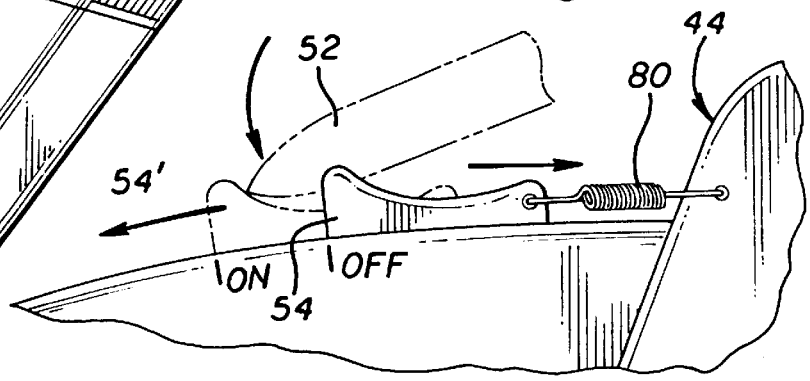
FIG. 6 is an isolated view illustrating operative engagement of a finger element of the assembly with a slide switch of the vacuum, to operate the switch between an on and off condition, in accordance with the embodiment of FIG. 4A.
Figure 7:
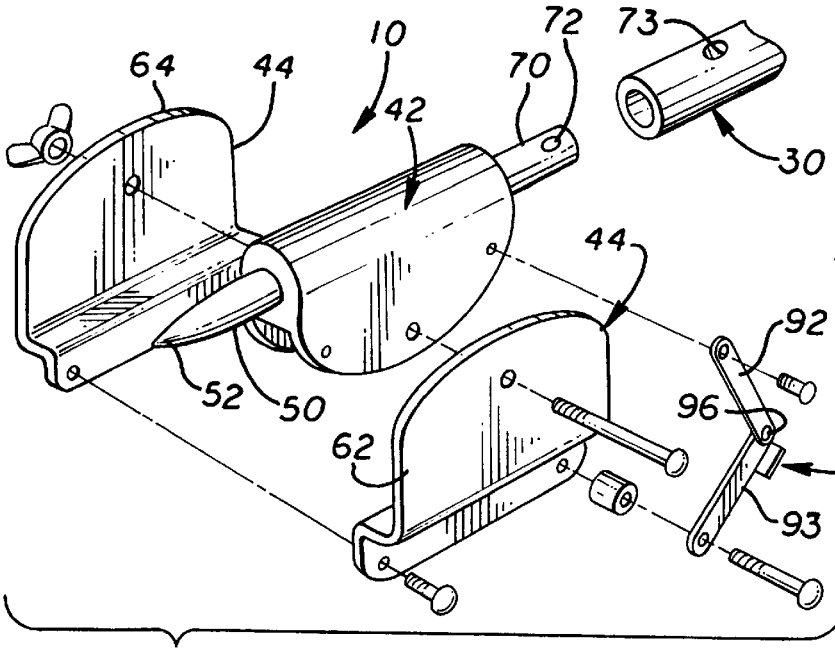
FIG. 7 is an exploded perspective view of yet another embodiment of the invention wherein the elongate shaft of the assembly is detachable from the attachment means.

In each of the embodiments shown in FIGS. 1A–9, the first and second members 42, 44 of the bracket 41 are structured to pivot at pivot point 46 when the assembly, including the vacuum, is lifted at handle 32. When the assembly is lifted, the weight of the vacuum 20 causes the vacuum and second member 44 to pivot relative to the first member 42 so that the tip 52 of finger 50 releases pressure on the on/off switch 54, thus deactivating the vacuum. Upon placing pressure on the vacuum intake 24 and/or on the bottom of the vacuum, by pressing against a surface to be vacuumed, the vacuum 20 and second bracket member 44 are caused to pivot about pivot point 46 so that the tip 52 on the first pivoting member 42 operates the on/off switch 54 to an on position, exerting pressure to either depress the switch 54 drum or slide switch 54 in the direction indicated by the arrows in the various figures, to thereby activate the vacuum. The second embodiment, seen in FIGS. 5A–8, includes a spring 80 to pull the slide type on/off switch 54' back to the off position upon releasing pressure on the vacuum intake 24, as tip 52 is released from the switch 54', as seen in FIG. 6.

Figure 4B:
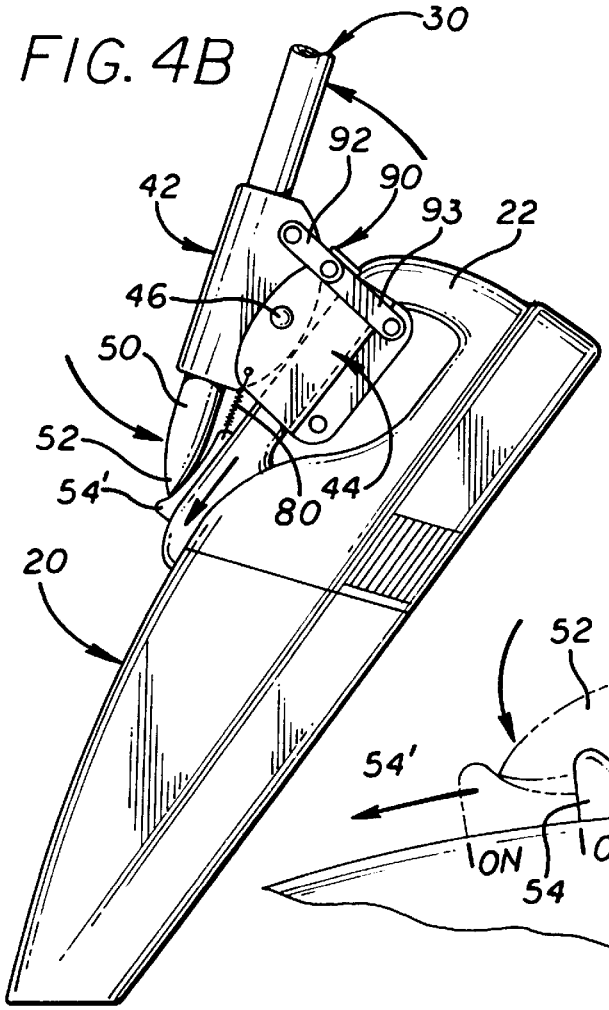
FIG. 4B is a side elevational view, showing the embodiment of FIG. 4A in an operative state wherein the vacuum is activated for use.

The attachment means 40 may further be provided with locking means 90, as seen in FIGS. 4A–5, for holding the pivot members 42, 44 in a locked position which maintains tip 52 in operative engagement with switch 54 (54') in the on position, to thereby maintain the vacuum in an activated state even with pressure released from the intake 24. The locking means 90 includes arms 92, 93 which hinge at point 96. Opposite ends of the arms 92, 93 pivotally attach to members 42, 44 respectively. A pressure plate 98, adjacent the hinge point 96 is pushed inwardly or pulled outwardly to extend or retract the opposite ends of the arms 92, 93. This allows the extension assembly 10 to be used for vacuuming curtains, drapes, shelves and other areas/objects requiring an extended reach, wherein it is difficult or impossible to apply and maintain pressure on the intake 24.

Figure 8:
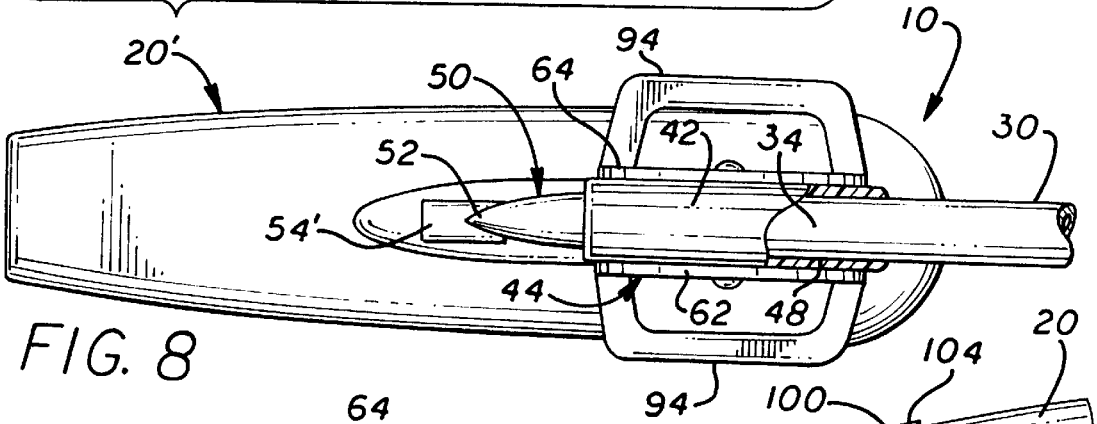
FIG. 8 is a top plan view of yet another embodiment of the present invention, shown attached to a portable vacuum, and including handle means on the attachment means.
Figure 9:
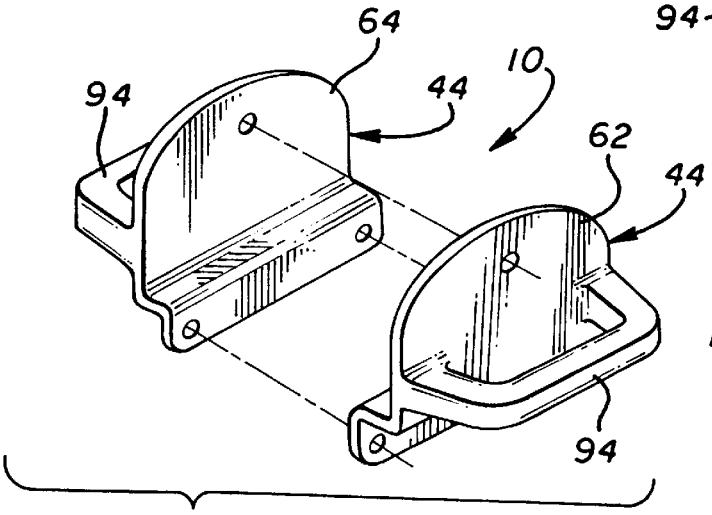
FIG. 9 is an exploded, perspective view of the attachment means with handle means in accordance with the embodiment of FIG. 8.

The halves 62, 64 may be provided with handle members 94, as shown in FIGS. 8 and 9, to provide added grasping means or a brace about the hand when using the vacuum independently of the extension shaft 30.

Figure 10:
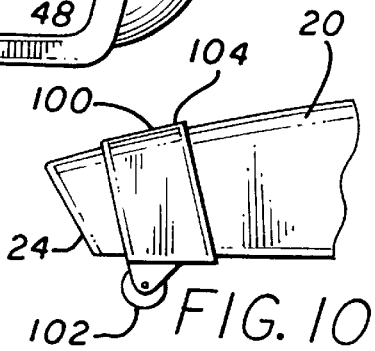
FIG. 10 is an isolated side elevational view, showing a wheel assembly of the present invention fitted to the housing of a portable vacuum adjacent the vacuum intake mouth.
Figure 11:
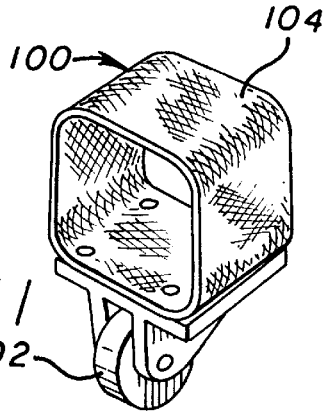
FIG. 11 is a perspective view of the wheel attachment assembly of FIG. 10.

FIGS. 10 and 11 illustrate a wheel attachment assembly 100 which is removably attachable to the vacuum 20 housing, adjacent the intake mouth 24, to provide roller means on the bottom of the vacuum. The wheel attachment assembly 100 includes a wheel 102 secured to an elastic band 104, or like means. The elastic band 104, being able to stretch, provides a universal fit about the housing neck of a wide range of models of vacuums from a variety of manufacturers. With the band 104 fitted to the vacuum housing, as seen in FIG. 10, the wheel 102 is held in fixed position just below the intake 24. Alternatively, the wheel can be attached to the vacuum housing using screws or a strong holding adhesive such as epoxy glue.

While the instant invention has been shown and described in what is considered to be preferred and practical embodiments thereof, it is recognized that modifications in both construction and configuration of the assembly 10 may be made without departing from the spirit and scope of the invention, as set forth in the following claims and within the doctrine of equivalents.

Now that the invention has been described,

What is claimed is:

1. A device for use with a portable vacuum having a housing with a handle grip portion, a suction intake mouth and an on/off switch for actuation of a vacuum motor within the housing;

said device comprising:

an elongate shaft having a proximal end zone, a mid zone and a distal end zone;

a finger element with a tip disposed in operative engagement with the on/off switch; and attachment means for attaching said distal end zone of said elongate shaft to the portable vacuum and including first and second pivoting members, movably interconnected at a pivot connection, said first pivoting member being releasably attachable to said distal end zone of said elongate shaft and said second pivoting member being releasably attachable to the handle grip portion of the portable vacuum, and said first and second pivoting members being movable relative to one another about said pivot connection upon application of an external force to cause said tip of said finger element to operate said on/off switch, thereby activating and deactivating the vacuum motor.

2. A device as recited in claim 1 wherein the proximal end zone of said elongate shaft includes handle means for grasping the proximal end zone.

3. A device as recited in claim 2 wherein said first pivoting member includes socket means for releasable receipt of said distal end zone of said elongate shaft therein.

4. A device as recited in claim 3 wherein said socket means includes locking means for releasably locking said distal end zone therein.

5. A device as recited in claim 2 wherein said second pivoting member includes:

opposing attachment members structured and disposed for surrounding and embracing the handle grip portion; and catch means for releasably interlocking said opposing attachment members in a closed position, in surrounding embracing relation about the handle grip portion to thereby attach the second pivoting member to the portable vacuum.

6. A device as recited in claim 2 wherein said elongate shaft includes telescoping means for selective adjustment of a length of said elongate shaft.

7. A device as recited in claim 2 wherein said central zone of said elongate shaft includes a plurality of telescoping sections movable relative to one another in telescoping relation and being structured for locked engagement with one another.

8. A device for use with a portable vacuum having a housing with a handle grip portion, a suction intake mouth, and an on/off switch for actuation of a vacuum motor within the housing;

said device comprising:

an elongate shaft having a proximal end zone, a mid zone and a distal end zone;

attachment means for attaching said distal end zone of said elongate shaft to the portable vacuum; and switch actuation means for operating the on/off switch to activate and deactivate the vacuum motor upon applying and releasing pressure at the suction intake mouth of the vacuum.

9. A device as recited in claim 8 wherein said switch actuation means includes switch lock means for maintaining the on/off switch in an on position so that the vacuum motor remains activated with and without pressure being applied at the suction intake mouth.

10. A device as recited in claim 8 wherein said elongate shaft includes telescoping means for selective adjustment of a length of said elongate shaft.

11. A device for use with a portable vacuum having a housing with a handle grip portion, a suction intake mouth, and an on/off switch for actuation of a vacuum motor within the housing;

said device comprising:

an elongate shaft having a proximal end zone, a mid zone and a distal end zone;

handle means on said proximal end zone of said elongate shaft for grasping the proximal end zone and manipulating the vacuum so that the suction intake mouth is moved across a surface for cleaning thereof;

attachment means for attaching said distal end zone of said elongate shaft to the portable vacuum; and switch actuation means for operating the on/off switch to activate and deactivate the vacuum motor upon applying and releasing pressure at the suction intake mouth of the vacuum, said switch actuation means including switch lock means for maintaining the on/off switch in an on position so that the vacuum motor remains activated with and without pressure being applied at the suction intake mouth.

* * * * *